United States Patent [19]

Kerdraon

[11] Patent Number: 4,606,272

[45] Date of Patent: Aug. 19, 1986

[54] INITIATION DELAY SYSTEM FOR WARHEADS WITH TANDEM MOUNTED SHAPED CHARGES

[75] Inventor: Alain L. Kerdraon, Bourges, France

[73] Assignee: Etat Francais, France

[21] Appl. No.: 701,033

[22] Filed: Feb. 12, 1985

[30] Foreign Application Priority Data

Feb. 20, 1984 [FR] France ..... 84 02487

[51] Int. Cl.[4] ..... F42B 1/02

[52] U.S. Cl. ..... 102/308; 102/309; 102/310; 102/202.8; 102/202.14; 102/202.12; 102/210; 102/476; 102/217

[58] Field of Search ..... 102/202.5, 202.8, 210, 102/306-310, 476, 202.12, 202.14, 217

[56] References Cited

U.S. PATENT DOCUMENTS

| | | | |
|---|---|---|---|
| 3,320,890 | 5/1967 | Ciccone et al. | 102/210 |
| 3,662,684 | 5/1972 | Bodinaux | 102/476 |
| 4,170,940 | 10/1979 | Precoul | 102/476 |
| 4,280,410 | 7/1981 | Weidner | 102/210 |
| 4,402,269 | 9/1983 | Smith | 102/202.5 X |
| 4,541,342 | 9/1985 | Routledge | 102/309 X |

FOREIGN PATENT DOCUMENTS

| | | | |
|---|---|---|---|
| 731987 | 4/1966 | Canada | 102/310 |

*Primary Examiner*—Peter A. Nelson
*Attorney, Agent, or Firm*—Parkhurst & Oliff

[57] ABSTRACT

The technical area of this invention is initiation delay mechanisms for warheads carrying two tandem-mounted shaped charges.

With this invention the initiation delay mechanism consists of using the movement of a screen placed between the forward charge 1 and the rear charge 2. According to a specific characteristic, as it moves, the screen can close an electric circuit by means of contactors placed in a given position. According to other variants, the screen can impact piezoelectric components generating energy or, in the case of a magnetic screen, can cross an induction coil.

Application in the field of projectiles and, particularly, of rockets and missiles.

12 Claims, 3 Drawing Figures

INITIATION DELAY SYSTEM FOR WARHEADS WITH TANDEM MOUNTED SHAPED CHARGES

This invention concerns an initiation delay system for warheads comprising two shaped charges mounted in tandem and initiated sequentially. The forward charge is initiated first, then, with a predetermined delay, detonates the rear charge.

Work on optimizing the design of tandem mountings of shaped charges to make them effective against active armor arrays shows that the interval between the firing of the two charges should be at least 1500 μS or even 2000 μS.

Such a delay of some hundreds of microseconds could be achieved without any problem with a coil of detonating cord, but for a delay of more than 500 μS, the length of cord needed becomes unworkable. In fact, it is necessary to use 3.5 m of cord for a delay of 500 μS or 10.5 m for 1500 μS. These extensive lengths pose a major problem because they are very cumbersome.

Moreover, the precision required with such delays (better than 5%) is unachievable with conventional explosive systems based on combustion-detonation transition phenomena and the use of primary explosives.

The invention seeks to remedy the drawbacks associated with the current state of the art by offering a highly precise delay system occupying little space.

The invention consists of using a shield placed between the two charges to effectuate the delay. In fact, it has been demonstrated that it is necessary to use a protective structure or screen to ensure protection of the rear charge when the forward charge is activated. It has been found that detonation of the first charge pushes the screen toward the back of the warhead and that the screen can buckle. The invention therefore consists of taking advantage of the movement of the screen to create a delay in the activation of the rear charge.

Thus, according to a first characteristic, the initiation delay results from the time it takes for part or all of the screen to move from its initial position to a given second position.

According to another characteristic, initiation of the rear charge is controlled by the closing of an electric circuit which occurs when the screen moves to the second position. The screen can include an electricity conducting component which, when the screen moves to the second position, closes the circuit for electric firing of the rear charge.

According to other particular characteristics:

At the time it moves to the second position, the screen impacts a piezoelectric device which delivers an electric control signal needed for initiation of the rear charge. The piezoelectric device comprises piezoelectric pellets placed in a ring around the circumference of the warhead.

The screen is made of a magnetic material and when it moves to the second position it crosses a coil generating an electric control signal necessary for initiation of the rear charge.

The delay between initiation of the first charge and the second is between 0.5 and 3 ms.

The invention can be better understood through the description for the attached drawings, where:

Figure 1:
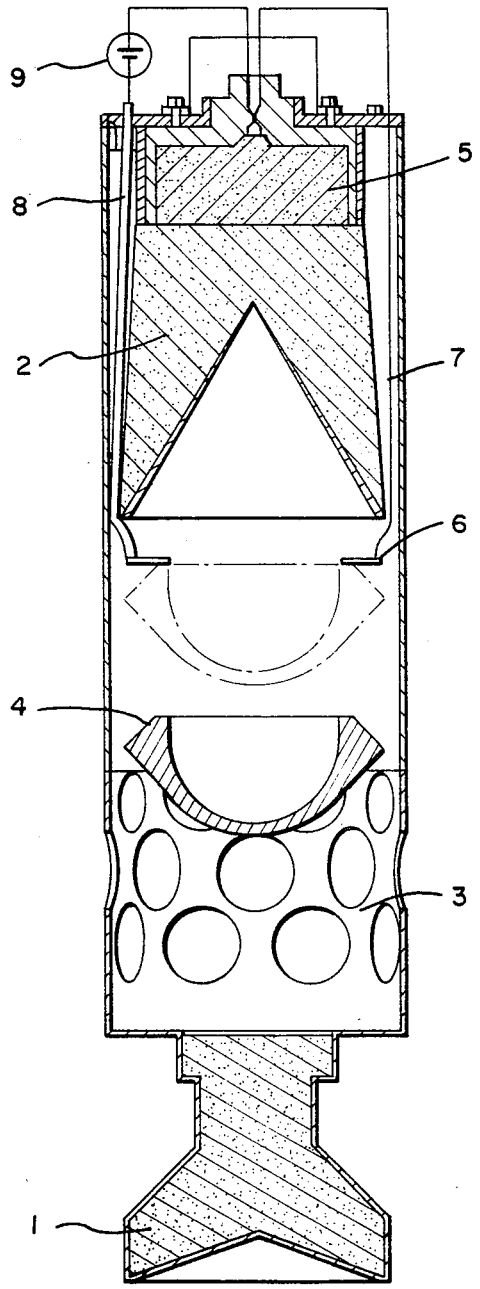
FIG. 1 shows a longitudinal cross section of a specific example of an application of the invention.

The warhead shown in FIG. 1 comprises a forward shaped charge (1) of flat type and a rear shaped charge (2) of hollow type. The two charges are placed in a fragmentable slip-ring (3). A screen (4) is placed between the two shaped charges in such a way to protect the rear charge when the forward charge is detonated.

Initiation of the two shaped charges is accomplished through primary systems (5) well-known to specialists in the field.

However, initiation of the rear charge (2) occurs with a predetermined delay after priming of the forward charge. According to the specific example shown in FIG. 1, contactors (6) are placed between the screen (4) and the rear charge (2). These contactors are connected by electric lines (7) and (8) to an electrical power supply (9) and to the priming device for the rear charge.

Thus when the forward charge is detonated, the screen moves toward the back of the warhead and strikes up against the contractors (6) which close the electric circuit and ensure activation of the priming device for the rear charge.

Figure 2:
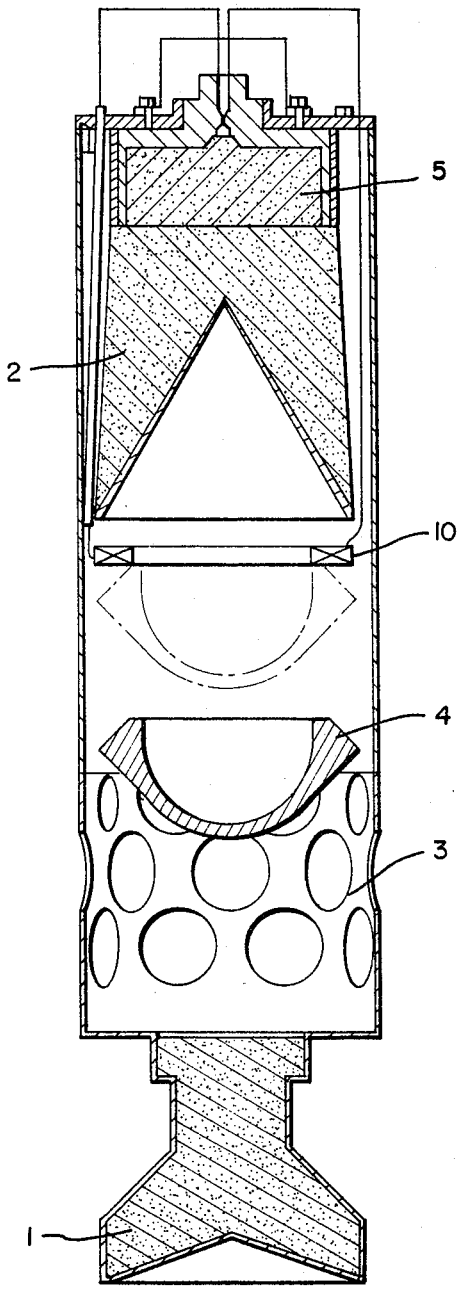
FIG. 2 shows a first variant using the invention.

FIG. 2 shows a variant on FIG. 1; in this case the contactors (6) are replaced by piezoelectric components (10) which upon impact with the screen (4) deliver an electric control signal which can be used either directly to initiate the rear charge's primer device, or indirectly to initiate a well-known electronic system whose purpose is to supply energy to the priming device from a built-in power supply.

Figure 3:
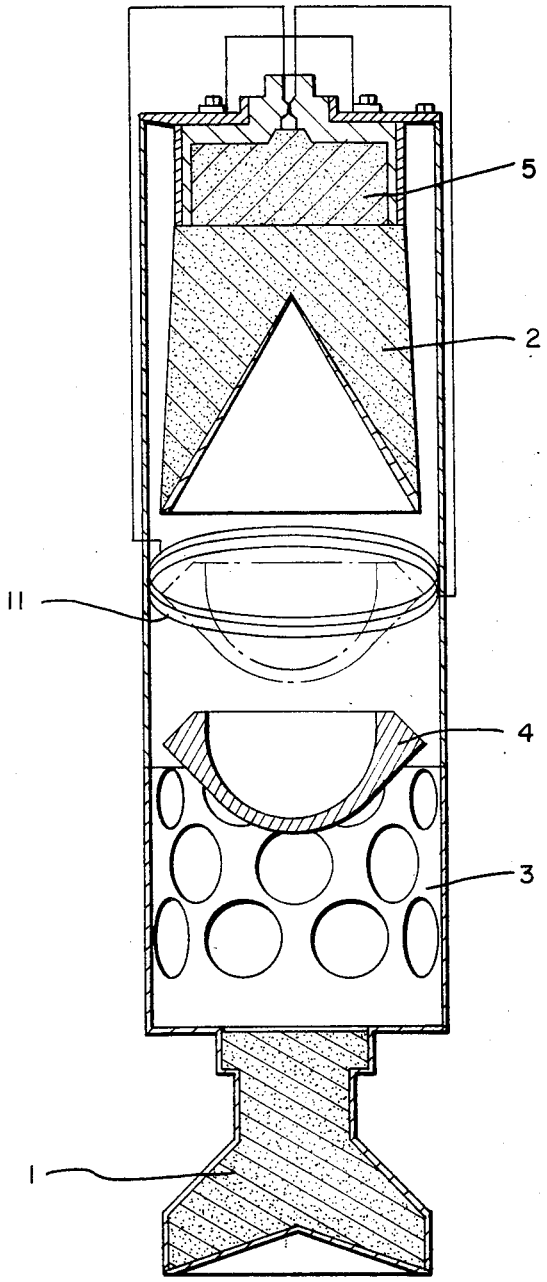
FIG. 3 shows a second variant using the invention.

FIG. 3 shows a warhead comprising an induction coil (11) placed between the rear charge and the screen (4). In this specific case, the screen is made of a magnetic material and inducts an electric current when it crosses the coil (11). This current, as in the case shown in the preceding figure, can be used directly or indirectly to prime the rear charge.

In all cases, for the system to work satisfactorily, the screen must not travel the entire distance initially separating the screen from the rear charge during the interval which separates the two firings. For example, for a warhead of the type shown in the various figures, the screen's velocity is 24 m/s; thus for a desired delay of 1 ms, the screen will have to move 24 mm to ensure activation of the rear charge.

One advantage of this system derives from the fact that the screen's (5) recoil is highly consistent, which allows very precise timing of delays.

Another advantage derives from the fact that the screen (5) takes on an additional function to the one it had before, which avoid complicating the device and makes possible a very compact warhead which can be easily integrated into any projectile.

What is claimed is:

1. An initiation delay mechanism for warheads comprising:

a forward shaped charge and a rear shaped charge mounted in tandem, said rear charge being initiated after a delay of a predetermined interval has elapsed following the initiation of the forward charge;

an electrical circuit for initiating said rear charge;

an initiation means for said forward charge; and, a screen placed between the forward charge and the rear charge, said screen moving backward to a second position as a result of an explosion of the first charge causing said electrical circuit of said rear charge to close, said predetermined interval of said delay comprising the time it takes the screen to move from an initial position to said second position.

2. The initiation delay mechanism of claim 1, wherein said electric circuit for initiating the rear shaped charge includes a power supply.

3. The initiation delay mechanism of claim 1 wherein the screen includes an electricity conducting component which when the screen moves to the second position, allows the closing of the circuit for the initiation of the rear charge.

4. The initiation delay mechanism of claim 1, wherein the screen as it moves to the second position impacts a piezoelectric device which delivers an electrical control signal needed to initiate the rear charge.

5. The initiation delay mechanism of claim 4, wherein the piezoelectric device comprises piezoelectric pellets placed in a ring around the circumference of the warhead.

6. The initiation delay mechanism of claim 1, wherein the screen comprises magnetic material and wherein as the screen moves to said second position a coil is crossed which generates an electric control signal which initiates the rear charge.

7. The initiation delay mechanism claim 1, wherein said predetermined interval of the delay is between 0.5 and 3 ms.

8. The initiation delay mechanism of claim 2, wherein said predetermined interval of the delay is between 0.5 and 3 ms.

9. The initiation delay mechanism of claim 3, wherein said predetermined interval of the delay is between 0.5 and 3 ms.

10. The initiation delay mechanism of claim 4, wherein said predetermined interval of the delay is between 0.5 and 3 ms.

11. The initiation delay mechanism of claim 5, wherein said predetermined interval of the delay is between 0.5 and 3 ms.

12. The initiation delay mechanism of claim 6, wherein said predetermined interval of the delay is between 0.5 and 3 ms.

* * * * *